US005806984A

United States Patent [19]

Yeager

[11] Patent Number: 5,806,984

[45] Date of Patent: Sep. 15, 1998

[54] RECLOSEABLE BAG WITH PROFILE STRIP FASTENER ASSEMBLY

[75] Inventor: James W. Yeager, Mobile, Ala.

[73] Assignee: Innoflex Incorporated, Alpharetta, Ga.

[21] Appl. No.: 675,714

[22] Filed: Jul. 3, 1996

[51] Int. Cl.[6] ..... B65D 33/04

[52] U.S. Cl. ..... 383/204; 383/61; 383/63; 383/66; 383/209; 383/210; 383/5

[58] Field of Search ..... 383/5, 61, 63, 383/66, 210, 211, 207, 209, 204

[56] References Cited

U.S. PATENT DOCUMENTS

| | | | |
|---|---|---|---|
| 3,181,583 | 5/1965 | Lingenfelter . | |
| 3,338,285 | 8/1967 | Jaster . | |
| 3,405,861 | 10/1968 | Bush . | |
| 3,426,959 | 2/1969 | Lemelson . | |
| 3,440,696 | 4/1969 | Staller . | |
| 3,532,571 | 10/1970 | Ausnit . | |
| 3,570,375 | 3/1971 | Williams et al. . | |
| 3,608,439 | 9/1971 | Ausnit . | |
| 3,717,244 | 2/1973 | Smith . | |
| 3,827,472 | 8/1974 | Uramoto . | |
| 3,948,705 | 4/1976 | Ausnit . | |
| 4,020,884 | 5/1977 | Jadot . | |
| 4,046,408 | 9/1977 | Ausnit . | |
| 4,094,729 | 6/1978 | Boccia . | |
| 4,241,865 | 12/1980 | Ferrell . | |
| 4,285,105 | 8/1981 | Kirkpatrick . | |
| 4,332,344 | 6/1982 | Strodthoff . | |
| 4,335,817 | 6/1982 | Bahr . | |
| 4,354,541 | 10/1982 | Tilman . | |
| 4,355,494 | 10/1982 | Tilman . | |
| 4,372,793 | 2/1983 | Herz . | |
| 4,479,244 | 10/1984 | Ausnit . | |
| 4,555,282 | 11/1985 | Yano . | |
| 4,570,820 | 2/1986 | Murphy | 383/61 X |
| 4,617,683 | 10/1986 | Christoff . | |
| 4,655,862 | 4/1987 | Christoff . | |
| 4,691,373 | 9/1987 | Ausnit | 383/63 |
| 4,782,951 | 11/1988 | Griesbach . | |
| 4,848,928 | 7/1989 | Ausnit | 383/61 X |
| 4,892,414 | 1/1990 | Ausnit | 383/63 |
| 4,894,975 | 1/1990 | Ausnit . | |
| 4,896,775 | 1/1990 | Boeckmann et al. | 383/63 X |
| 4,909,017 | 3/1990 | McManhon . | |
| 4,925,316 | 5/1990 | Van Erden et al. | 383/61 |
| 4,993,844 | 2/1991 | Robinson et al. . | |
| 5,022,530 | 6/1991 | Zieke . | |
| 5,024,537 | 6/1991 | Tilman . | |
| 5,036,643 | 8/1991 | Bodolay . | |
| 5,050,736 | 9/1991 | Griesbach . | |
| 5,116,140 | 5/1992 | Hirashima . | |
| 5,167,608 | 12/1992 | Steffens, Jr. et al. . | |
| 5,186,543 | 2/1993 | Cochran . | |
| 5,461,845 | 10/1995 | Yeager | 383/66 X |
| 5,601,368 | 2/1997 | Bodolay et al. . | |

FOREIGN PATENT DOCUMENTS

| | | | |
|---|---|---|---|
| 452 430 | 12/1966 | Denmark . | |
| 0 485 741 A1 | 10/1991 | European Pat. Off. . | |
| 0528721 | 2/1993 | European Pat. Off. | 383/61 |
| 1 423 849 | 11/1964 | France . | |

*Primary Examiner*—Jes F. Pascua
*Attorney, Agent, or Firm*—Rockey, Milnamow & Katz, Ltd.

[57] ABSTRACT

A package in the form of a recloseable bag includes a bag body including front and back walls, and a profile strip fastener assembly sealingly mounted on the inside surface of the front wall. The profile strip fastener assembly includes a pair of releasably interlocking profile strips, with a secondary, peelable seal provided between the profile strips apart from their mechanically interlocked portions. By this arrangement, enhanced sealing for the package is provided, while abating the stress to which the interlocked portions of the profile strips are subjected during forming and filling of the package. The bag body preferably includes a removable panel substantially aligned with the fastener assembly for gaining access to the assembly, with the removable panel desirably providing tamper-evidence of opening of the package.

4 Claims, 5 Drawing Sheets

RECLOSEABLE BAG WITH PROFILE STRIP FASTENER ASSEMBLY

TECHNICAL FIELD

The present invention relates generally to flexible bag-like packages, and more particularly to a flexible recloseable bag package including an improved profile strip fastener assembly mounted on a front wall of the body of the bag, thus facilitating use on conventional form, fill, and seal machinery.

BACKGROUND OF THE INVENTION

Recloseable packaging is particularly suited for packaging of food products when it is desired to repeatedly remove relatively small quantities of the food product. Such food products include cereals, rice, candies, and the like, and may also include meat food products, such as chicken, frankfurters, sliced meats, etc. While the use of recloseable flexible bags having twist-tie wire fasteners or plastic clasps has long been known, recent advents in recloseable packaging have included configuring packages to have integral zipper-type fastener assemblies, including interlocking profile strips. In such arrangements, the package is typically opened by cutting or tearing a portion of the package to gain access to the fastener assembly, with opening and closing of the profile strips of the fastener assembly thereafter permitting the package to be selectively opened and closed.

While packages having integrated profile strip fastener assemblies are becoming common in the marketplace, heretofore, such arrangements have typically require specialized packaging machinery for forming and filling such packages. Significantly, U.S. Pat. No. 5,461,845 discloses a recloseable package, and method of formation, which is specifically configured to facilitate use on conventional, so-called form, fill, and seal machinery. This type of machinery forms and fills packages with food product (or other articles) by forming a package from a web of plastic material or the like, and substantially simultaneously filling and sealing the package. The package disclosed in the above-referenced patent includes a profile strip fastener assembly which is configured such that a plurality of fastener assemblies can be provided on a substantially continuous web of package-forming material, with the web then stored in rolled or fan-folded form prior to use. The web of packaging material can then be supplied to a conventional form, fill, and seal machine, with the machine operated in a generally conventional manner to package the product as desired. By the provision of the profile strip fastener assembly in the front wall portion of the package, convenient recloseability of the package is provided without resort to twist-tie fasteners, plastic clasps, or the like. The above-referenced patent is hereby incorporated by reference.

The present invention contemplates a recloseable package in the form of a bag which is configured for use with conventional form, fill and seal machinery, while providing enhanced sealed integrity for the package as well as tamper-evidence of opening.

SUMMARY OF THE INVENTION

A package in the form of a recloseable bag embodying the principles of the present invention includes a profile strip fastener assembly which is joined to a front wall of a bag body in a manner which permits formation of the bag in web form prior to use with a conventional form, fill and seal machine. Notably, the profile strip fastener assembly includes a peelable seal, in addition to the closure formed by the interlocking profile strips of the assembly, thus enhancing the sealing integrity of the fastener assembly during package formation, filling, and subsequent storage and use.

In accordance with the illustrated embodiment, the present recloseable bag includes a bag body formed from a rectangular sheet of film material, such as plastic film material or the like. The bag body has a top end, a bottom end, a front wall, and a back wall, wherein the front wall is joined to the back wall by upper and lower seams respectively provided at the top and bottom ends of the bag body.

A recloseable profile strip fastener assembly is joined to the front wall of the bag body and comprises first and second interlocking profile strips which respectively extend along the length of the fastener assembly. The profile strips are configured for releasable interlocking engagement with each other by the provision of at least one elongated protuberance on one of the profile strips, and at least one groove defined by the other of the profile strips for respectively releasably receiving the protuberance.

The fastener assembly is specifically configured for independent securement to the inside surface of the front wall of the bag body, and to this end, the first profile strip of the assembly includes a body flange portion joined to an inside surface of the front wall. Similarly, the second profile strip includes another body flange portion joined to the inside surface of the front wall of the bag body.

In order to enhance the sealing integrity of the fastener assembly, and to better carry loads to which the assembly is subjected during formation, filling, shipment, and storage of the package, one of the profile strips of the fastener assembly includes a seal flange portion, with the assembly including a seal formed between the seal flange portion of the one profile strip, and the body flange portion of the other one of the profile strips. In this manner, the seal must be opened to provide access to the opening between the first and second profile strips when they are released from interlocking engagement with each other.

In the preferred embodiment, the front wall of the bag body includes an elongated, frangibly removable portion which is substantially aligned with the fastener assembly. This removable portion provides access to the seal and interlocking profile strips of the fastener assembly after the portion is removed from the front wall of the bag body. The provision of this removable portion in the bag body desirably provides tamper-evidence of opening of the bag.

Other features and advantages of the present invention will become readily apparent from the following detailed description, the accompanying drawings, and the appended.

DETAILED DESCRIPTION

Figure 1:
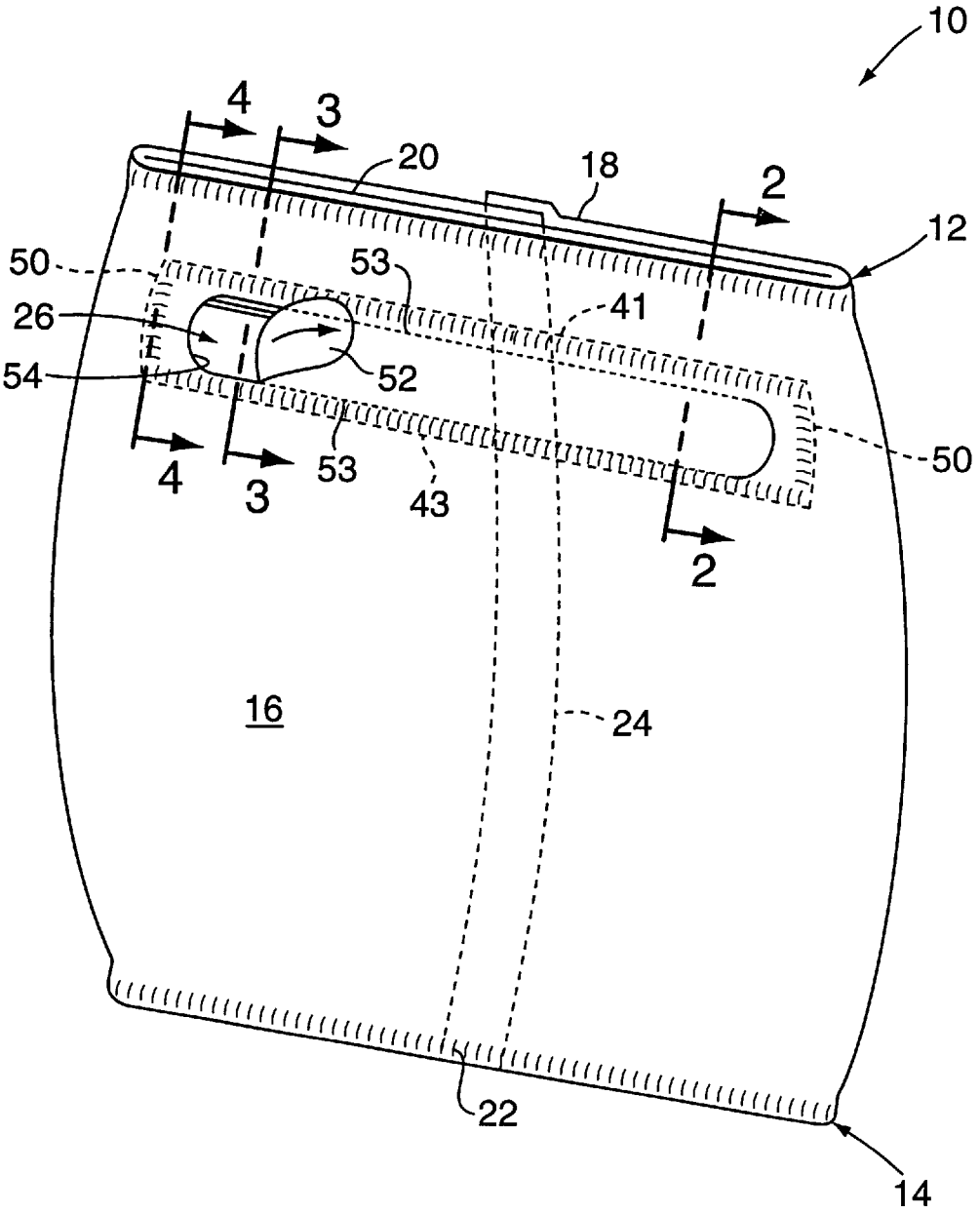
FIG. 1 is a perspective view of a package in the form of a recloseable bag embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiments illustrated.

With reference now to the drawings, therein is illustrated a package in the form of a recloseable bag 10 embodying the principles of the present invention. It is contemplated that the bag 10 be formed from suitable plastic film materials or the like, but it is within the purview of the present invention to form the bag from paper or paper-like materials. As will hereinafter be described, bag 10 is specifically configured in a manner which facilitates formation of the bag from a substantially continuous web of film material, to which fastener assemblies have been previously applied, for use in a so-called form, fill, and seal apparatus for packaging of food products, or non-food products. For example, the present package can be configured for packaging of non-food items such as hardware articles or the like, wherein repeated opening and closing of the package is desired.

The recloseable bag 10 is formed from a generally rectangular sheet of film material, and includes a top end generally designated 12, a bottom end generally designated 14, and front and back walls 16 and 18. The front and back walls are joined to each other by upper and lower seams 20, 22, respectively provided at top and bottom ends 12 and 14 of the bag. Lateral edges of the rectangular sheet of film material from which the bag body is formed are joined to each other along a back seam 24 extending vertically along back wall 18. The seams 20, 22, and 24 can be formed adhesively, or by heat-sealing as is known in the art.

Recloseable bag 10 includes profile strip fastener assembly 26 which is sealingly mounted on the inside surface of front wall 16. In order to permit use of the present bag with conventional packaging equipment, fastener assembly 26 has a length no more than one-half the width of the rectangular sheet of film material from which the bag body is formed. In practice, a substantially continuous sheet of film material is provided with a plurality of the fastener assemblies 26 mounted thereon at spaced locations, which spacing corresponds to the length dimension of the bags ultimately to be formed. For use, this web of film material (with the fastener assemblies mounted thereon) is supplied to a form, fill, and seal apparatus which operates to form a series of the bags 10, in end-to-end relationship, by formation of back seam 24, bottom seam 22, and top seam 20, as food product is supplied to the individual bags being formed. After formation and filling, the individual bags are ordinarily separated from each other for packaging and shipment, as may be required.

Figure 2:
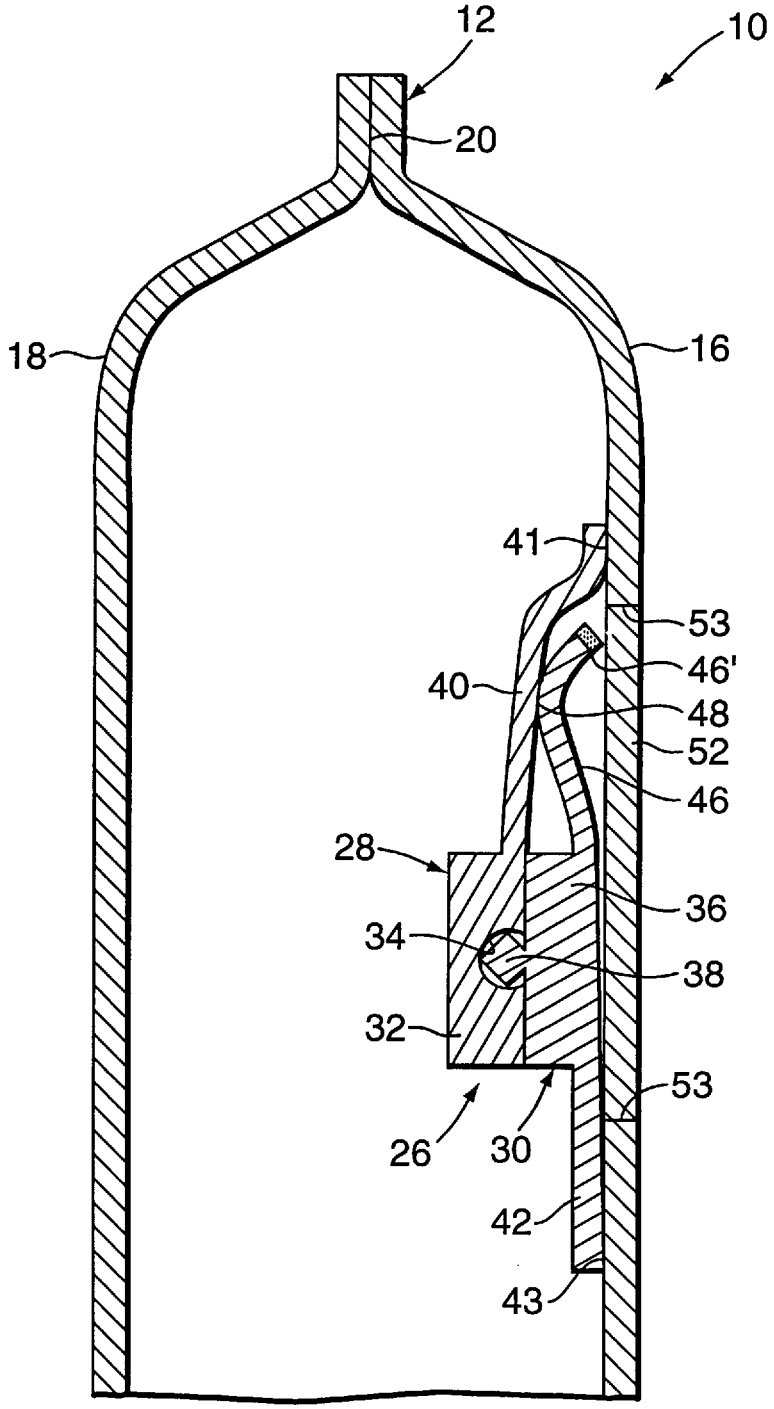
FIG. 2 is a fragmentary cross-sectional view taken along lines 2—2 of FIG. 1.

With particular reference to FIG. 2, the fastener assembly 26 includes a first elongated profile strip 28, and a second elongated profile strip 30 which are configured for releasable interlocking engagement with each other. While the specific configuration of the profile strips can be varied while keeping with the principles disclosed herein, it is contemplated that one of the profile strips (first strip 28 in the illustrated embodiment) includes a body 32 which defines at least one elongated groove 34, while the other profile strip (second strip 30) includes a body 36 which defines at least one protuberance 38 configured for respective interlocking engagement with the groove 34. As will be recognized by those familiar with the art, the number of grooves and protuberances, and their respective disposition on the first and second profile strips, can be varied while keeping with the principles disclosed herein.

The fastener assembly 26 is sealingly mounted on the inside surface of the front wall 16 of the body of the recloseable bag 10, and to this end, each of the profile strips 28, 30, includes an elongated flange portion joined to the inside surface of the front wall. Specifically, first profile strip 28 includes a body flange portion 40 which is joined to the inside surface of front wall 16 by elongated seal 41. Similarly, second profile strip 30 includes a body flange portion 42 which is joined to the inside surface of front wall 16 by elongated seal 43. It is within the purview of the present invention that seals 41, 43 may be formed with the use of suitable adhesive, or may be provided by heat-sealing or the like. The seals 41, 43 are preferably continuous for strength and for sealing of the contents of the bags, but discontinuous seals may be suitable for some applications.

In this first embodiment of the present invention, at least one of the flange portions of the first and second profile strips 28, 30 is unitary with the respective body of the profile strip by formation of the flange portion from the same piece of material as the respective body (in this embodiment, the bodies of both profile strips are unitary with their respective flange portions). As further disclosed herein, it is within the purview of the present invention that at least one of the flange portions of the profile strips be formed from material which differs from that from which the respective body of the profile strip is formed.

As will be observed in FIG. 2, it is presently preferred that the body flange portion 40 of first profile strip 28 be positioned in substantially flush and coextensive relationship with that surface of the body 32 which defines groove 34. This preferred arrangement desirably facilitates sealing of the ends of the profile strips to each other, thus enhancing the sealing integrity of the resultant construction.

The nature of the profile strips 28, 30 is such that the interlocking portions of the strips can be configured to provide desirably high load-carrying characteristics, while at the same time still being readily manually detached from each other. However, in order to desirably reduce the stress to which the interlocked profile strips are subjected during bag formation and filling, and subsequent handling, the fastener assembly embodying the principles of the present invention includes a secondary, peelable seal which detachably joins the profile strips to each other, apart from the releasable engagement of protuberance 38 in the groove 34.

In the illustrated embodiment, this secondary securement is provided by the provision of a seal flange portion 46 extending upwardly from the body of second profile strip 30, with a peelable seal 48 provided between the flange portion 46 and the body flange portion 40 of first profile strip 28. In the preferred form, the peelable seal 48 is provided in spaced relationship to the free edge 46' of flange portion 46, with the free edge 46' thus facilitating gripping of the flange portion for convenient separation and peeling of the seal 48. If desired, the free edge 46' can be provided with contrasting coloring or the like to facilitate its manipulation during opening of the package. As will be recognized by those familiar with the art, peelable seals such as 48 are well known, such as disclosed in U.S. Pat. No. 5,050,736, hereby incorporated by reference. Peelable seals such as seal 48 are configured to peel open easily using minimal opening forces by utilizing low sealing temperatures, reduced dwell times, and light sealing pressures. Peelable seals can also be produced by utilizing a single polymer or from a combination of polymers that molecularly produce low seal strengths. While seal 48 can be pre-formed as part of the fastener assembly 26 prior to its securement to the web or during its securement to the web from which bag 10 is formed, it may be desirable for some applications to form seal 48 at the time of filling of the bag.

Figure 4:
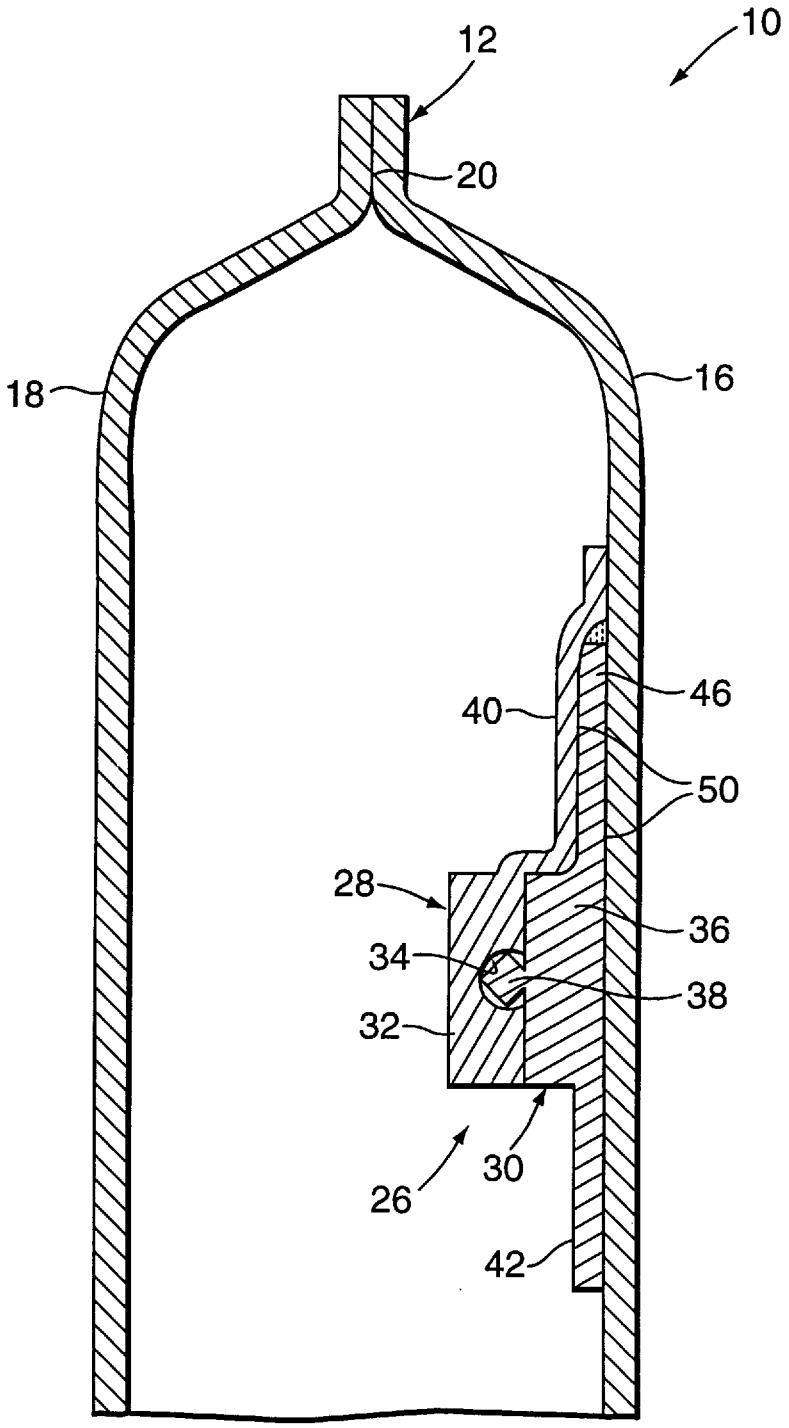
FIG. 4 is a fragmentary cross-sectional view taken along lines 4—4 of FIG. 1.

As will be appreciated, the seal 48 preferably is configured to extend substantially the entire length of the fastener assembly 26, thus desirably acting to provide an additional seal for the contents of the bag 10 in addition to the seal provided by interlocked portions of the profile strips 28, 30. Further sealing of the contents of the bag against air and moisture transmission is preferably effected by the provision of end seals 50 at respective opposite ends of the fastener assembly 26. End seals 50, as illustrated in FIG. 4, desirably act to sealingly join respective ends of the profile strips 28, 30 to each other, as well as join ends of the fastener assembly 26 to the inside surface of front wall 16. As will be recognized, end seals 50 can be formed to completely seal the ends of the fastener assembly 26 to the inside surface of the front wall 16, with the further provision of peelable seal 48 acting with the end seals 50 to substantially completely seal the region of the recloseable bag at which the fastener assembly 26 is provided (this can be desirable when the body of the bag is perforated to provide access to fastener assembly 26, as described below). Additionally, end seals 50 prevent slippage of the profile strips 26, 28, thus avoiding any potential misalignment when reclosing the fastener assembly.

Figure 3:
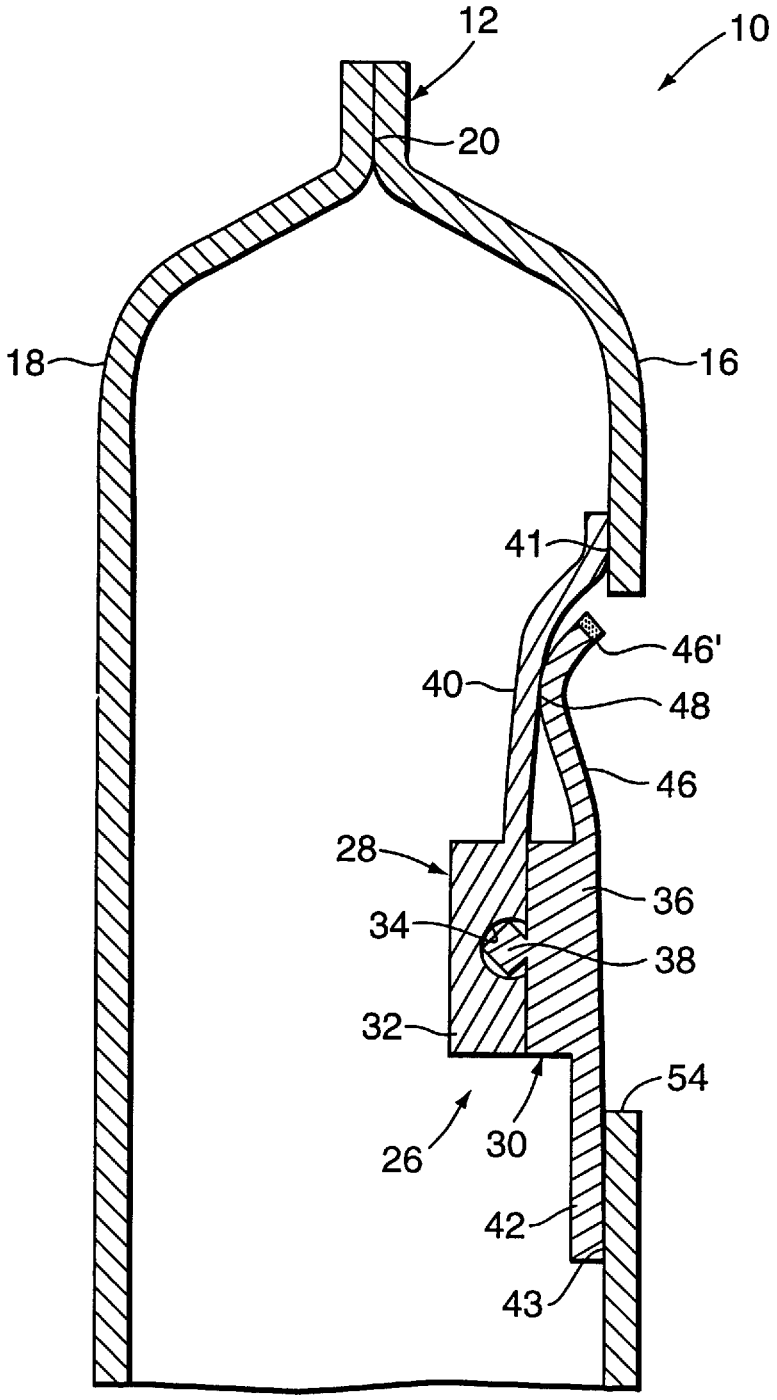
FIG. 3 is a fragmentary cross-sectional view taken along lines 3—3 of FIG. 1.

Access to the fastener assembly 26 from the exterior of the package is preferably provided by the provision of an elongated, frangible region, substantially aligned with fastener assembly 26, which in the illustrated embodiment comprises an elongated frangibly removable panel 52 formed unitarily with the front wall 16 of the bag body. A line of perforations, or other preferentially weakened region aligned with fastener assembly 26, may alternately be employed. The removable panel 52 is preferably defined by a preferentially weakened frangible portion, such as by perforations 53, with removal of the panel 52 resulting in formation of an elongated opening 54 by which access to fastener assembly 26 is provided (see FIG. 3). Removal of the panel 52 permits grasping of free edge 46' of seal flange portion 46, whereby peelable seal 48 can be readily opened. After separation and opening of seal 48, profile strips 28, 30 can be easily separated by disengagement of protuberance 38 from groove 34, thus permitting access to the contents of the package. As will be recognized, the provision of seal flange portion 46 permits manipulation and separation of the profile strips of the fastener assembly by grasping of portion 46, without excessive stressing of the bag body. This is desirable since some plastic film materials (such as polypropylene and high density polyethylene) tend to tear easily, with resultant propagation of the tear.

Figure 5:
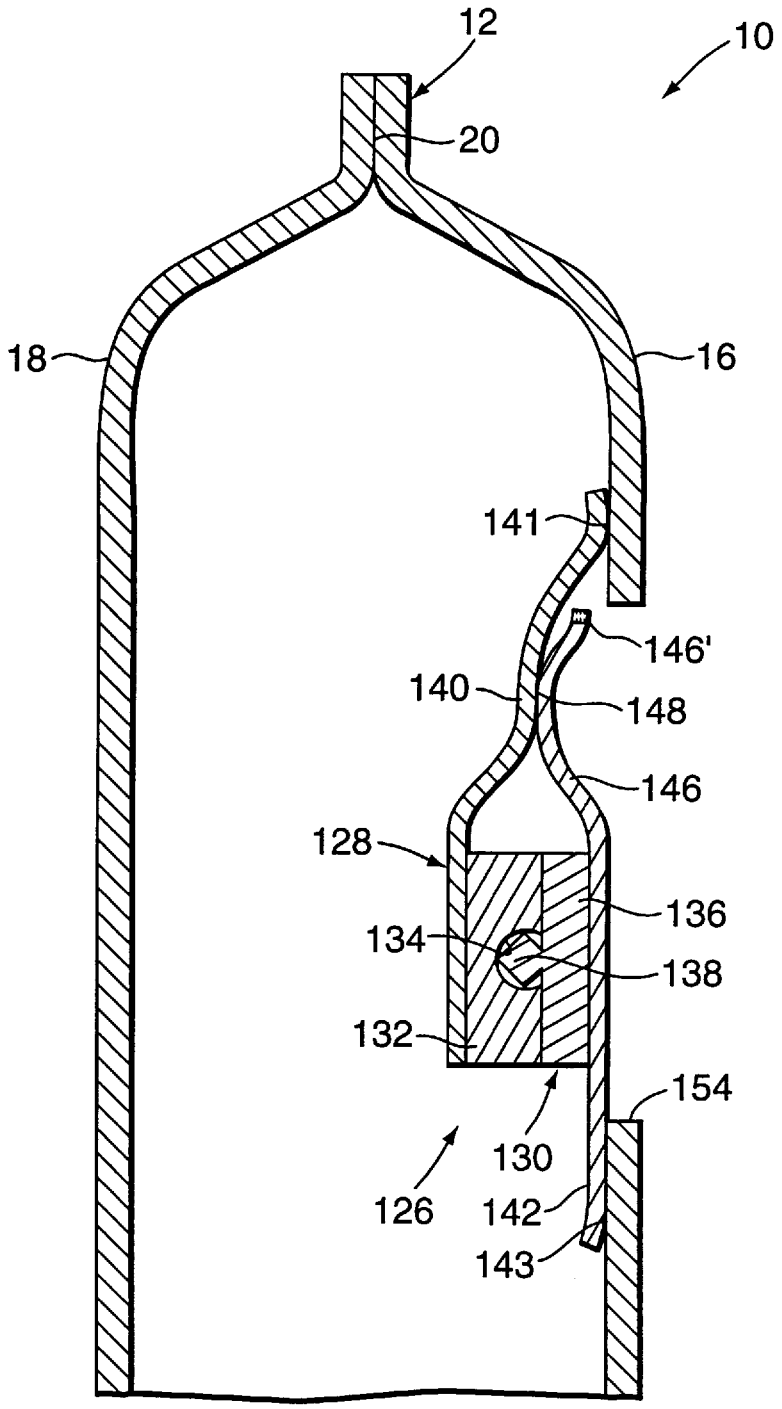
FIG. 5 is a fragmentary cross-sectional view similar to FIG. 3, illustrating an alternate embodiment of the present invention.

FIG. 5 illustrates an alternate embodiment of the present recloseable bag 10, wherein features of the bag corresponding to those of the previously-described embodiment are designated by like reference numerals in the one-hundred series. In particular, this alternate embodiment of the recloseable bag 10 includes a profile strip fastener assembly 126, wherein the flange portions of each profile strip of the assembly are integral with the bodies of the profile strips, but are formed from different material.

In particular, the illustrated fastener assembly 126 includes a first profile strip 128, and a second profile strip 130. First profile strip 128 includes a body 132 which defines one or more elongated grooves 134. In turn, second profile strip 130 includes a body 136 having one or more protuberances 138 each respectively engageable with the one or more grooves 134.

Securement of the fastener assembly 126 to the inside surface of front wall 16 of the recloseable bag is effected by the provision of elongated flange portions, which flange portions are formed from different material than the bodies 132, 136 of the first and second profile strips. In particular, first profile strip 128 includes a body flange 140 joined to the inside surface of front wall 16 at preferably continuous, elongated seal 141. Similarly, second profile strip 130 includes a body flange portion 142 joined to the inside surface of the front wall of the bag body by a preferably continuous, elongated seal 143.

The second profile strip 130 further includes a seal flange portion 146, which may be unitary with body flange portion 142, with the flange portion 146 joined to the body flange portion 140 of first profile strip 128 by a peelable seal 148. A free edge 146' of the seal flange portion 146 facilitates gripping and separation of the seal 148 upon removal of the panel 52 from the front wall 16 of the bag body, thus providing access to the contents of the package. The configuration of the present package illustrated in FIG. 5 can be desirable for use with certain perishable products that must be packaged in a manner which limits the amount of oxygen to which the products are exposed. For packaging of such products, the bodies 132, 136 of the first and second profile strips can be separately manufactured, and the flange portions 140, 142, 146 thereafter respectively attached to the bodies. The bodies of the profile strips are normally produced from low pressure polyethylene due to the close tolerances required for the desired interlocking relationship of the components, and for ease of manufacturing. In contrast, the flange portions of the profile strips can be formed from material which is substantially different from low pressure polyethylene for relatively low oxygen transmission, such as nylon.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover by the appended claims all such modifications as fall within the scope of the claims.

What is claimed is:

1. A tamper-evident bag having improved oxygen barrier properties comprising a bag body formed from a rectangular sheet of film material, said bag body having a top end, a bottom end, a front wall, and a back wall, said front wall being joined to said back wall by upper and lower seams respectively provided at said top and bottom ends; and a recloseable fastener assembly joined to said front wall and comprising first and second interlocking profile strips respectively extending along the length of the fastener assembly, said profile strips having bodies configured for releasable interlocking engagement with each other by the provision of at least one protuberance on one of said profile strips, and at least one groove defined by the other of said profile strips for respectively releasably receiving said protuberance, said bodies of said profile strips being formed from polyethylene, said first profile strip including a body flange portion joined to an inside surface of said front wall of said bag body by an elongated, continuous seal extending the entire length of said fastener assembly, and said second profile strip including another body flange portion joined to the inside surface of said front wall of said bag body by another elongated, continuous seal extending the entire length of said fastener assembly, said body flange portions of said profile strips being formed from material which is substantially different from polyethylene for relatively low oxygen transmission therethrough, said fastener assembly including end seals at respective opposite ends of said fastener assembly for joining said respective ends of said profile strips to each other and to said inside surface of said front wall of said bag, one of said first and second profile strips including a seal flange portion, said fastener assembly including a peelable seal formed between and joining said seal flange portion of said one profile strip to the body flange portion of the other one of said strips on the same side of the body flange portion of the other one of said strips that is joined to said inside surface of said front wall so that said seal must be opened to provide access to said first and second profile strips whereby they can be released from interlocking engagement with each other, said peelable seal extending the entire length of said fastener assembly and acting with said end seals to substantially completely seal the region of said recloseable bag at which said fastener assembly is provided, said seal flange portion of said profile strip being formed from material which is substantially different than low pressure polyethylene for relatively low oxygen transmission therethrough, said bag including a frangible region in said front wall, said frangible region comprising perforations and being substantially aligned with said fastener assembly thereby providing access to said fastener assembly through said front wall.

2. A recloseable bag in accordance with claim 1, wherein said flange portion of at least one of said profile strips is positioned in substantially flush and coextensive relationship with said body portion.

3. A recloseable bag in accordance with claim 1, wherein at least one of said profile strips is joined to said front wall by adhesive.

4. A recloseable bag in accordance with claim 1, wherein said body flange portions are formed from nylon.

* * * * *